United States Patent [19]

Cowell

[11] 4,191,889

[45] Mar. 4, 1980

[54] PREHEAT CIRCUIT FOR X-RAY TUBES

[75] Inventor: David Cowell, Webster, N.Y.

[73] Assignee: Sybron Corporation, Rochester, N.Y.

[21] Appl. No.: 857,257

[22] Filed: Dec. 5, 1977

[51] Int. Cl.[2] ..... H05G 1/00

[52] U.S. Cl. ..... 250/402; 250/408

[58] Field of Search ..... 250/402, 403, 409, 408, 250/401, 421

[56] References Cited

U.S. PATENT DOCUMENTS 3,925,672 12/1975 Soder et al. ..... 250/402

*Primary Examiner*—Craig E. Church
*Assistant Examiner*—Thomas P. O'Hare
*Attorney, Agent, or Firm*—Theodore B. Roessel; J. Stephen Yeo

[57] ABSTRACT

A circuit for use with a X-ray tube applies filament power to preheat the tube prior to the application of high voltage. The preheat duration is made to be in inverse relation to the line voltage. The desired result is when the tube starts to conduct the tube current and tube voltage is held within acceptable limits regardless of line voltage variations.

2 Claims, 2 Drawing Figures

PREHEAT CIRCUIT FOR X-RAY TUBES

BACKGROUND OF THE INVENTION

This invention relates to medical and dental X-ray systems and more particularly is concerned with circuits for affecting the voltage or current applied to the filament of an X-ray tube.

A simple and cost efficient X-ray system includes a high voltage transformer for applying high voltage in the order of 80 kilovolts across the cathode and plate of a Coolidge type X-ray tube. The primary of the high voltage transformer is energized by line voltage. The cathode of the tube is heated by a filament, which is supplied voltage by means of a low voltage transformer also operating from line voltage. In many X-ray tubes, the cathode and the filament are electrically connected and in fact may be the same structure. Often, for cost purposes, the output of the high voltage transformer is connected directly to the tube without any intervening rectifiers. The tube will then act as a self rectifier, conducting only during alternate half cycles of the high voltage. During conduction, electrons emitted from the hot cathode strike the plate of the tube which reacts by emitting X-rays. For a given time interval, the dosage of X-rays emitted is a function of tube voltage and tube current. To provide correct dosage, it is common to stabilize or control both or either tube voltage and current, so that variations in the line voltage will not seriously effect X-ray dosage. Quite a few schemes are known to stabilize current and voltage. Of these, many are rather costly. Furthermore, developments in high speed X-ray film have allowed dosage to be reduced to only a few half cycles, which may not be enough time for many systems to stabilize the current. It has therefore, become the practice to preheat the filament of the X-ray tube prior to the application of high voltage for an interval called preheat time.

It is known that the current of the tube is a function of filament temperature as well as other factors. The higher the filament temperature, the more current will flow from the plate to the cathode. The flow of current through the tube changes the voltage from the transformer due to the high resistance of the high voltage winding. The higher the current flow through the tube, the higher will be the voltage drop and the lower the high voltage across the tube. While simple preheat circuits do somewhat stabilize tube current, they do not offer fine correction for variations in the line voltage. If the preheat time is too short, the filament is relatively "cold" and the first few current pulses will be low causing a corresponding high voltage to be developed. Conversely, too long a time causes excessive initial current pulses and the kilovoltage is reduced. In the prior art, the preset preheat time is normally an integral number of half cycles of the input power, the precision of timing can be no better than one-half cycle of power. Thus, a set preheat time may be perfect for one particular line voltage, but as soon as the line voltage changes, the preheat time becomes less than perfect and considerable errors occur.

It is the main object of this invention to overcome this limitation so as to provide filament preheat cycles having continuous compensation for line voltage variation.

DESCRIPTION OF THE INVENTION

The invention controls the duration of filament preheat time in inverse relation to line voltage variations. The higher the line voltage, the less time the filament will be heated before high voltage is applied to the x-ray tube. This is to compensate for the increase in filament voltage corresponding to the increase in line voltage.

Figure 1:
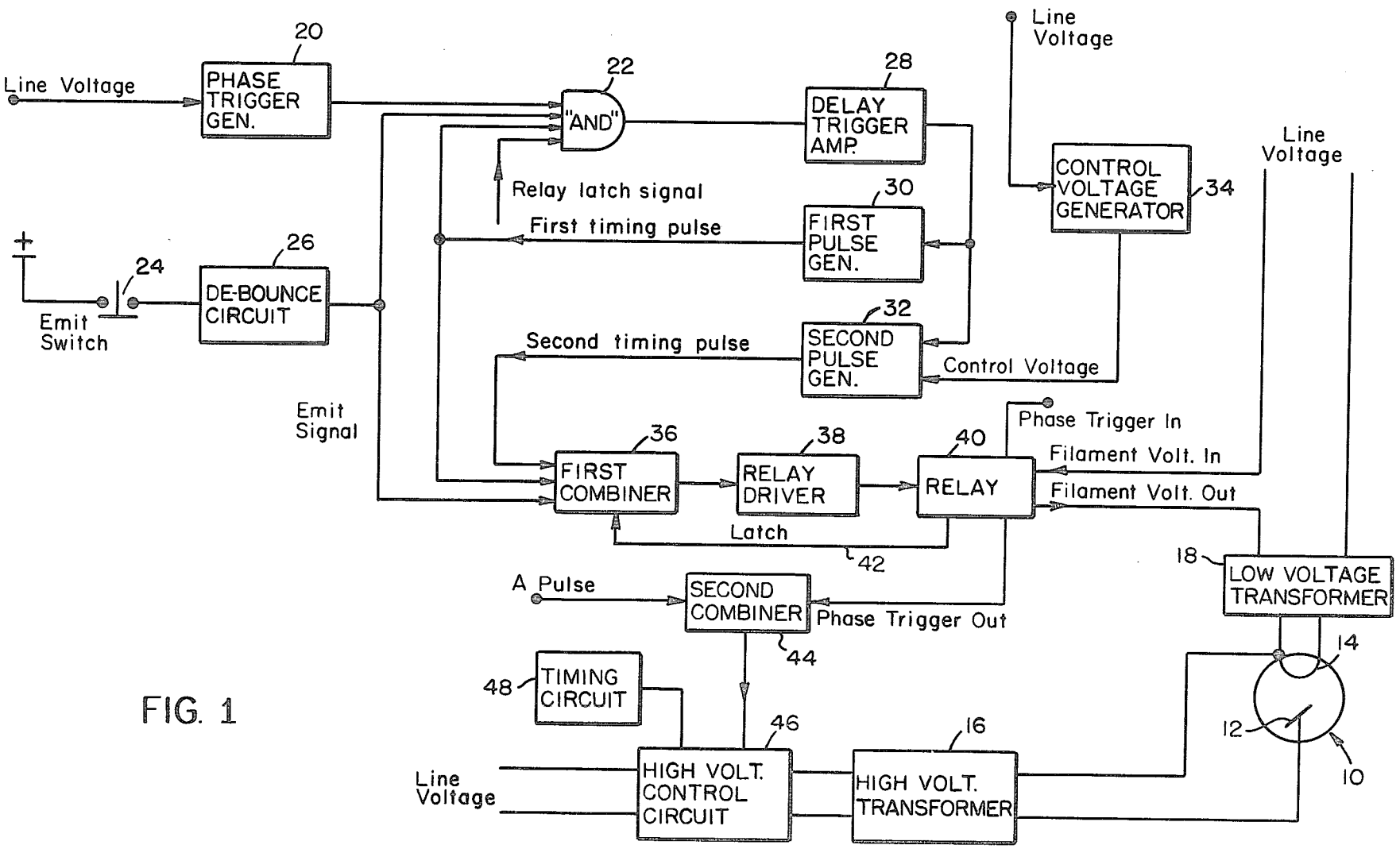
FIG. 1 is a block diagram of an X-ray system using a preheat circuit which is an embodiment of my invention.
Figure 2:
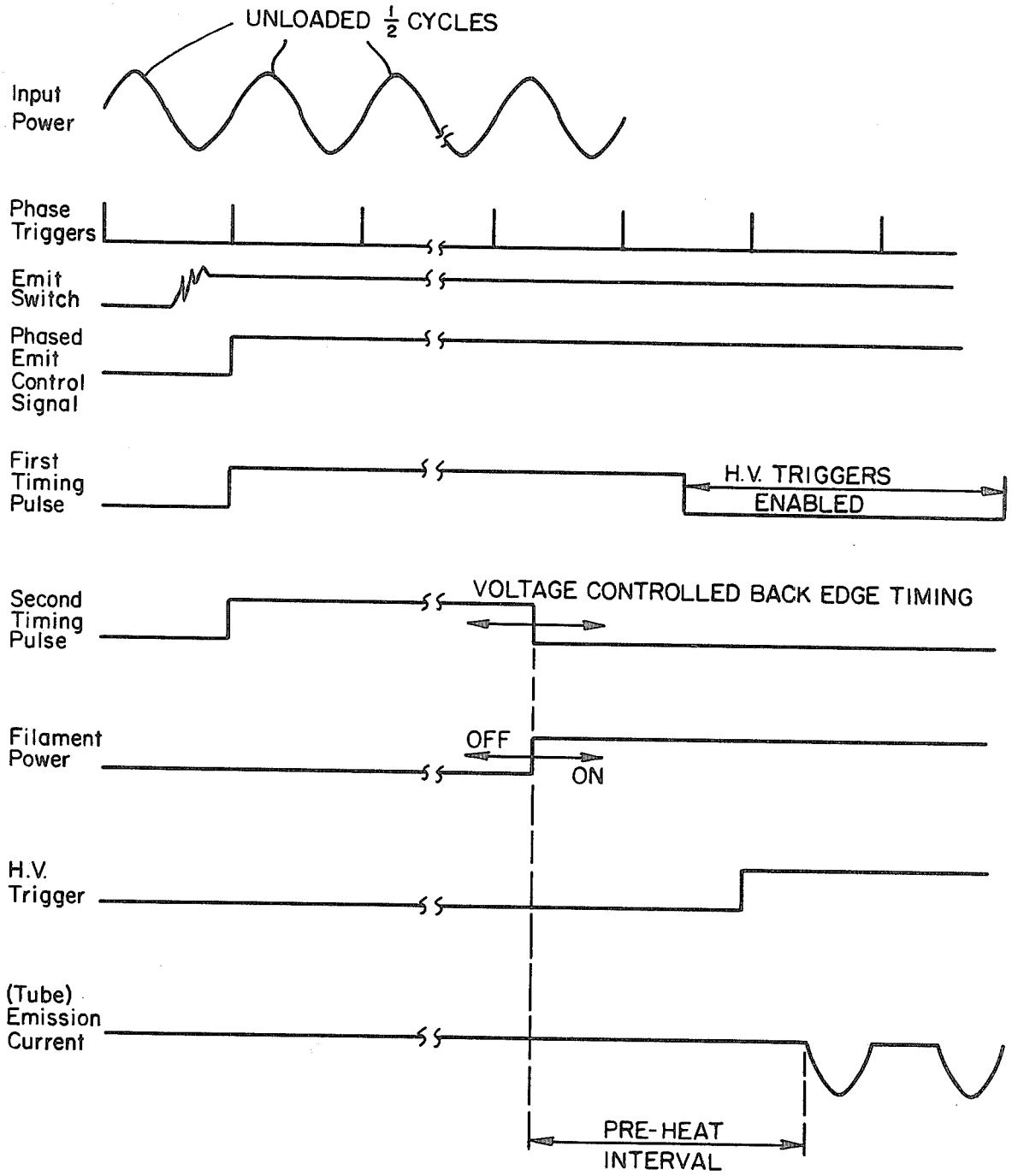
FIG. 2 is a series of various signals or conditions which vary over time in the circuit of FIG. 1.

Referring to the drawings, there is seen in FIG. 1 the preferred embodiment of my invention. FIG. 2 represents signals present in the circuit of FIG. 1. An X-ray tube 10, such as the Coolidge type has a plate 12 and a filament and cathode. The filament and cathode may be the same physical structure 14 as shown in the drawing. Line voltage is transformed by high voltage tranformer 16 to kilovoltage which is directed across the cathode 14 and the plate 12 of the X-ray tube 10. The filament 14 is provided low voltage, by low voltage transformer 18 energized by line voltage. The X-ray tube will emit X-ray's when electrons strike the plate. This occurs to a useable extent only when both high voltage and filament voltage are applied to the tube. It is to be understood that the high voltage appearing across the tube is not merely a function of the turns ratio of high voltage transformer, but is also related to the tube current and impedance of the transformer. Initial tube current is partially a function of filament temperature, which this circuit controls by varying the preheat time in response to line voltage.

The system will now be explained by observing its functions through an emit cycle. Assume that at time zero the system is connected to a line voltage but the tube is not in emission.

Phase trigger generator 20 supplies a phase trigger every cycle on alternate zero crossings of the line voltage. Then, trigger pulses are directed toward one of four inputs of AND gate 22. The AND gate 22 provides an output only when each of the inputs simultaneously receive signals of a particular polarity. If AND gate 22 does not have all the required inputs no output results.

When X-ray emission is desired, the operator depresses an emit switch 24, which is connected to a debounce circuit 26. An emit signal is directed to one input of the AND gate 22 instigating an emit cycle. The two remaining inputs to the AND gate 22 will be explained later, but for now assume that the enabling inputs are present at these two inputs.

When the emit signal and the phase trigger are both present at the AND gate 22, the gate provides an output which is amplified by delay trigger amplifier 28, which provides a pulse generator triggering signal which is directed to a first pulse generator 30 and a second pulse generator 32. The first pulse generator 30 generates a first timing pulse having a fixed duration typically hundreds of milliseconds long. The width is selected so that the back edge falls between two trigger pulses.

The second pulse generator 32 provides a second timing pulse of variable duration. The particular duration of the second timing pulse is determined by control voltage from control voltage generator 34, which in turn is a function of the amplitude of the line voltage.

The higher the line voltage the longer the duration of the second timing pulse, while conversely, the lower the line voltage, the shorter the duration of the second timing pulse. As will be shown, the back edge of the second timing pulse controls the application of filament power for the start of the preheat intervals via relay contacts or other control device so that the longer the second pulse is, the shorter is the preheat time. The first and second timing pulses are directed toward a first combiner 36 as is the emit signal.

The combiner 36 has an output connected to a relay driver 38, which drives relay 40. Immediately after the emit switch is depressed, there will be at first combiner 36 these three signals. The second timing pulse acts as an inhibitor preventing the relay 40 from the closing. When the duration of the second timing pulse expires, the first combiner 36 is arranged to close the relay 40 upon the presence of the emit signal and the first timing pulse. When the relay 40 closes, a latching feedback 42 circuit prevents the relay 40 from opening until the emit switch is released.

When the relay 40 is closed, the filament voltage is turned on and the phase trigger is allowed to pass to a second combiner 44. The first timing pulse is also directed to second combiner 44. The first timing pulse inhibits the second combiner 44. At the expiration of the fixed period of the first timing pulse, the second combiner 44, upon the presence of the next phase trigger, enables a high voltage control circuit 46 to turn on, applying high voltage to the tube 10.

Returning to the two as yet unexplained inputs of the AND gate, it is seen that the first timing pulse is connected to one input and the latch signal is connected to the last input. This arrangement prohibits unwanted retriggering of the pulse generators 30, 32 while the emit switch 24 is still depressed.

We now review the conditions at the tube 10 in relation to the pulses. After emit switch is depressed, two timing pulses are caused to be generated. During the co-existence of these two timing pulses, no voltage appears at the tube. At the expiration of the second timing pulse, which is shorter than the first pulse, the filament voltage is applied to the tube. Only the filament voltage is applied until the expiration of the first timing pulse which is terminated between phase triggers. At the appearance of the following trigger pulse, both the filament voltage and the high voltage are applied to the tube.

The amount of time when only the filament voltage is on, but not the high voltage, is called the preheat time. The longer the preheat time for a given voltage, the hotter the filament will be and the more current will flow across the tube. The amount of current flowing in the tube affects the voltage drop of the transformer and thereby the voltage appearing across the tube. The length of preheat time is determined by the difference in duration between the first timing pulse and the second timing pulse. The mathematical law relating input line voltage to optimum preheat time involves many parameters. I have found, however, that a linear law has been an adequate approximation, the second timing pulse duration being a continuous linear function of line voltage. The circuit will control initial filament temperature and thus tube current regardless of moderate variations in line voltage. Furthermore, high voltage will be first applied to the tube only at zero cross over, as result of the phase trigger being an enabling signal.

Preferably, the phasing is arranged so that the high voltage is applied to the beginning of the non-conducting off cycle of the tube, so that the high voltage transformer is unloaded. This allows the high voltage transformer to be in the correct part of the B-H loop to avoid excessive inrush currents with subsequent waveform distortion and component damage. As the input voltage reverses through zero, the emission current commences.

This invention is directed toward a preheat circuit prior to the application of high voltage. Subsequent to the application of high voltage, further stabilization circuits and timing means may be wanted to maintain a correct X-ray dosage. In any case, further stabilization and timing means is outside of the scope of this invention and is only represented by a functional block 48.

I claim:

1. A preheat circuit for X-ray tubes requiring filament voltage and high voltage, said circuit consisting of a first pulse generator providing a first timing pulse of fixed duration, a second pulse generator providing a second timing pulse of variable duration less than the duration of said first timing pulse; means for enabling said first and second pulse generators so that said first timing pulse and said second timing pulse initiate simultaneously; means responsive to line voltage for controlling the length of said second timing pulse in relation to the line voltage; means responsive to said first and second timing pulses for applying filament voltage to a X-ray tube upon the termination of said second timing pulse; and means for applying high voltage to the X-ray tube after the termination of said first timing pulse.

2. The preheat circuit of claim 1, which further includes:

a trigger pulse generator which generates a trigger pulse upon alternate zero cross overs of the line voltage and wherein said first timing pulse is terminated between trigger pulses and wherein said means for applying high voltage to the X-ray tube is inhibited by the first timing pulse, but enabled by trigger pulses, so that the high voltage is applied to the X-ray tube upon the first trigger pulse following the termination of the first timing pulse with result that the high voltage is applied to the tube when the line voltage and the corresponding high voltage is at zero cross over.

* * * * *